US010773117B1

(12) United States Patent
Goldberg et al.

(10) Patent No.: US 10,773,117 B1
(45) Date of Patent: Sep. 15, 2020

(54) ERGONOMIC LIFTING SYSTEM

(71) Applicants: Lee Goldberg, Arden, NC (US); Eric Marbach, Boynton Beach, FL (US)

(72) Inventors: Lee Goldberg, Arden, NC (US); Eric Marbach, Boynton Beach, FL (US)

( * ) Notice: Subject to any disclaimer, the term of this patent is extended or adjusted under 35 U.S.C. 154(b) by 0 days.

(21) Appl. No.: 16/583,487

(22) Filed: Sep. 26, 2019

Related U.S. Application Data

(60) Provisional application No. 62/787,983, filed on Jan. 3, 2019.

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC ... A63B 21/06; A63B 21/0601; A63B 21/072; A63B 21/0724; A63B 21/0728
USPC ..... D21/680–682
See application file for complete search history.

(56) References Cited

U.S. PATENT DOCUMENTS

| | | | | |
|---|---|---|---|---|
| D433,720 | S * | 11/2000 | Rojas | D21/680 |
| 6,615,885 | B1 | 9/2003 | Ohm | |
| 6,991,590 | B2 | 1/2006 | Vigiano | |
| 7,198,591 | B2 | 4/2007 | Lien | |
| 10,010,741 | B2 | 7/2018 | Rothschild | |
| 2001/0049324 | A1 | 12/2001 | Wallace | |
| 2004/0166997 | A1* | 8/2004 | Vigiano | A63B 21/06 482/93 |
| 2005/0245369 | A1 | 11/2005 | Vigiano | |
| 2008/0200315 | A1 | 8/2008 | Lin | |
| 2017/0080274 | A1 | 3/2017 | Dickerson | |
| 2017/0113088 | A1 | 4/2017 | Hollingshead | |
| 2018/0345114 | A1* | 12/2018 | Sites | A63B 71/0054 |
| 2018/0361192 | A1 | 12/2018 | Dickerson | |

* cited by examiner

*Primary Examiner* — Jennifer Robertson
(74) *Attorney, Agent, or Firm* — Garrity Traina, PLLC; Christopher Davis-Traina

(57) ABSTRACT

A disc-shaped weight plate has a peripheral rim and a collar. The collar receives a barbell that may be lifted by a user. Between the peripheral rim and the collar is a lattice. The lattice has hexagonal holes, some of which are truncated by the peripheral rim or collar.

3 Claims, 4 Drawing Sheets

ERGONOMIC LIFTING SYSTEM

CLAIM OF PRIORITY

The present non-provisional patent application claims priority to U.S. Provisional Application No. 62/787,983 filed Jan. 3, 2019, which is incorporated herein by reference in its entirety.

BACKGROUND OF THE INVENTION

Field of the Invention

This invention relates to an ergonomic weightlifting plate.

Description of the Related Art

Weight training has long been a staple of fitness workout routines. Recent years in particular have seen a rise in incorporation of weight training methods. Methods incorporating high-intensity interval training, Olympic weightlifting or powerlifting techniques have become particularly popular. These include methods practiced in home gyms, dedicated gyms, personal trainers, and studios dedicated to popular brands of training.

These sorts of fitness methods employ numerous types of training equipment. Prominent among the types of equipment is the barbell. And, many exercise routines, such as dead-lifts, clean-and-jerks, cleans, and snatches, that incorporate a barbell are performed while the exerciser is in a standing car squatting position, i.e., with two feet on the ground.

A standard barbell of the type found in most gyms weighs between 35 pounds and 45 pounds Disc-shaped weight plates with radially-centered bores are slid over the ends of the barbell to add to and customize the weight for a particular exerciser.

Importantly, the diameter of the barbell is much lower than the diameter of the weight plates. An unloaded barbell placed on the ground only provides half an inch of clearance, which is enough clearance for an exerciser's hands to be able to grip the barbell, and they must bend further and lift the barbell a higher total distance. By contrast, a loaded barbell with weight plates can provide on the order of 7-9 inches of clearance.

This results in a particular challenge faced by all exercisers, but perhaps more strongly by novice athletes or athletes suffering from or recovering from injury or other impairment.

Many exercisers will opt to train using only the weight of the unloaded barbell, which as stated above can be 35 pounds to 45 pounds Because an unloaded barbell has significantly less clearance than a loaded one, this means the exerciser has to squat or bend much further to grip a barbell placed on the ground. The additional movement, often approx. 8.5 inches, compromises proper exercising form and creates mobility issues. Compromised form leads to improper technique and can easily result in injury.

Exercisers will often attempt to mitigate the challenge by using adding weight plates. However, the most commonly available weight plates add an additional 10 pounds to each end of the barbell, totaling 20 pounds Relative to a barbell weighting between 35 pounds and 45 pounds, a 20 pounds increase is significant. And, for some exercisers, it is dangerous.

Some users resort to using plywood discs because they are inexpensive, and simple to make. However, plywood is still heavy. Plywood is also flimsy and can fracture or splinter under stress or when the barbell is dropped, and thus poses a significant safety hazard.

Other users resort to elevating the barbell by placing it atop blocks that sit on the floor. At least one system of blocks is commercially available under the trade name "Jerk Blocks." However, blocks come with significant drawbacks. They are heavy and quite large, and thus cumbersome to move. As a result, they are simply not an option for many home gyms or gyms where space is limited, whether by size or number of participants. And, blocks of suitable durability can be very expensive, costing in excess of $600 per set and thus pricing many gyms out of the option altogether.

Accordingly, what is needed is a solution that provides the ergonomic advantage of using a loaded barbell, but that minimally increases the weight of the barbell. Such a device should take up minimal space and be easily movable. It should also be compatible with commonly available barbells. Additionally, it should be durable enough to be dropped without damage or endangering the user.

SUMMARY OF THE INVENTION

The present invention is directed to an ergonomic weightlifting plate. The present invention has a body with a bore extending through it to receive a barbell. The barbell may be, by way of example, a commonly used barbell typically in the range of 35 pounds to 45 pounds.

With one or more of the plates positioned at each end of the barbell, the barbell is elevated from the ground a sufficient distance to facilitate proper weightlifting technique on the part of the user. This also helps prevent a user from overextending or overstressing lower back muscles to reach a barbell too close to the ground, as would be the case if a user attempted to exercise without any plates on the barbell at all.

Additionally, the body of the plate has a lattice that comprises a plurality of holes extending through the plate. The lattice as depicted in the accompanying figures is primarily a hexagonal lattice, through other types of lattices such as but not limited to square, triangular, rhombic, parallelogrammatic, or rectangular may be used. Among other advantages, these holes considerably reduce the weight of the plate. As a result, a plate according to the present invention will in many cases weigh substantially less than a traditional weightlifting plate that has similar dimensions.

The lattice allows the present invention to maintain durability, often including cases in which the barbell is dropped by a user.

Various embodiments of the present invention may weight as little as 1.5 pounds to 2.5 pounds per plate, while maintaining a similar radius as an Olympic or bumper-style plate. As a result, a plate according to the present invention will allow a user to train with similar ergonomics, such as placing the barbell a similar distance above the ground, while adding as little as 3 pounds to the barbell. Thus, users who may struggle to lift a standard barbell with an additional 20 pounds of standard weight plates can instead opt for plates according to the present invention, and thereby safely and properly exercise.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Both the foregoing general description and the following detailed description are exemplary and explanatory only and are not restrictive of the invention claimed. As used herein, "or" means "and/or" unless expressly stated otherwise. Furthermore, the use of the singular includes the plural unless specifically stated otherwise, and use of the term "including" as well as other forms, such as "includes," and "included," shall not be considered limiting. Any individual features described may be combined with other features as required by different applications.

Figure 1:
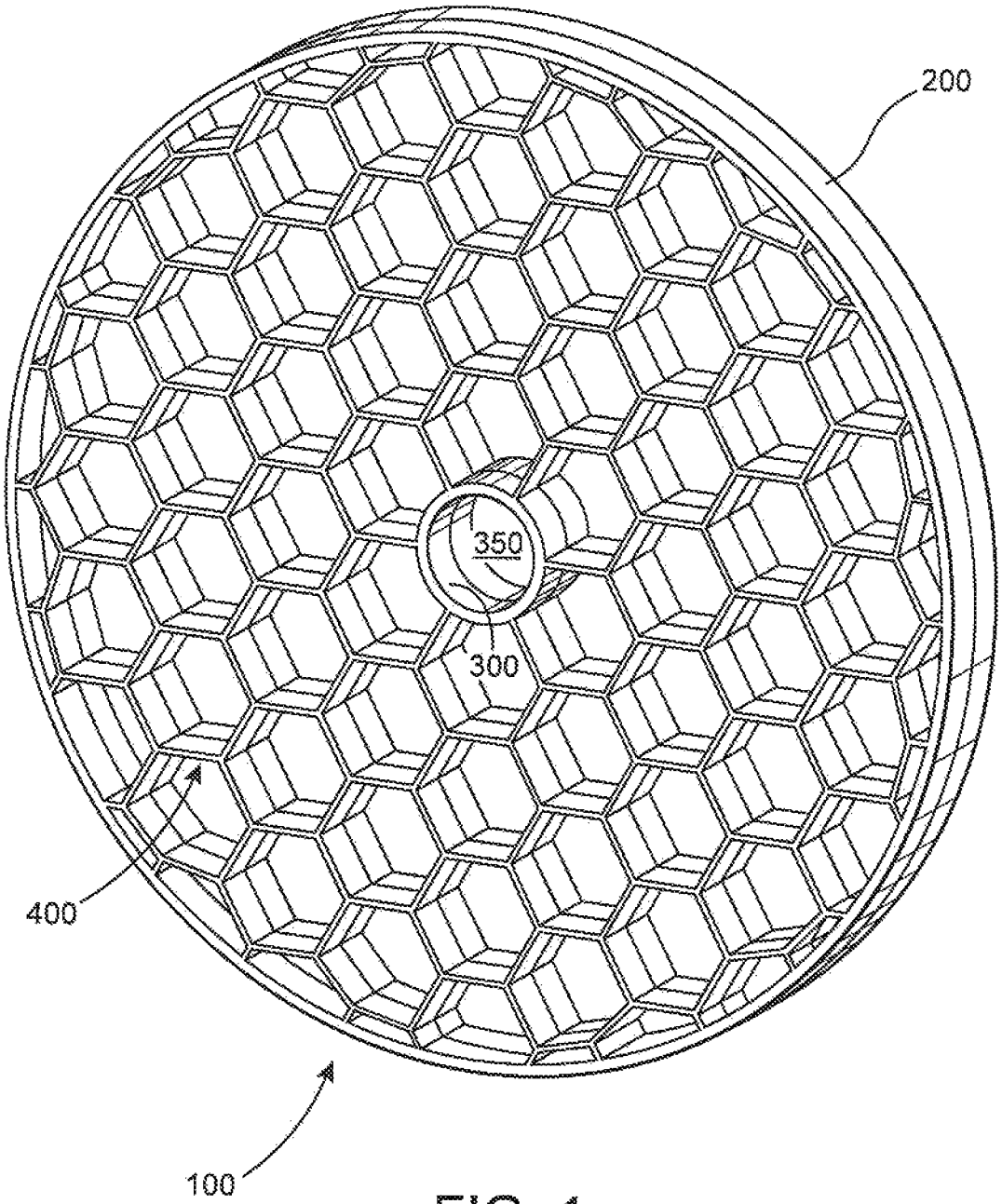
FIG. 1 is a perspective view of an embodiment of the present invention.

FIG. 1 is a perspective view of an embodiment of the present invention. An ergonomic weightlifting lifting plate 100 is depicted. The plate 100 may be made of any number of suitable materials or combination thereof to achieve the desired balance between a lightweight but durable plate 100. In one such embodiment, as is depicted in FIG. 1, the plate 100 primarily comprises a thermoplastic vulcanite material of construction. In at least one embodiment, this material has a hardness of between 40 Shore D and 60 Shore D, inclusively, when measured by a durometer, though alternate embodiments may use materials with a hardness outside this range. At least one embodiment is entirely formed of such a material.

The plate 100 includes a peripheral rim 200 forming the outermost boundary of the plate 100. The peripheral rim 200 of FIG. 1 is circular. However, other embodiments may use a variety of other shapes for the rim, including polygons such as a hexagon or octagon.

A collar 300 is radially disposed in the plate 100. As described in further detail herein, the collar 300 defines a bore 350. The bore 350 is dimensioned and configured to receive a barbell. Though the bore 250 of FIG. 1 is circular, the shape may vary for other embodiments.

A lattice 400 extends between the peripheral rim 200 and the collar 300.

Figure 2:
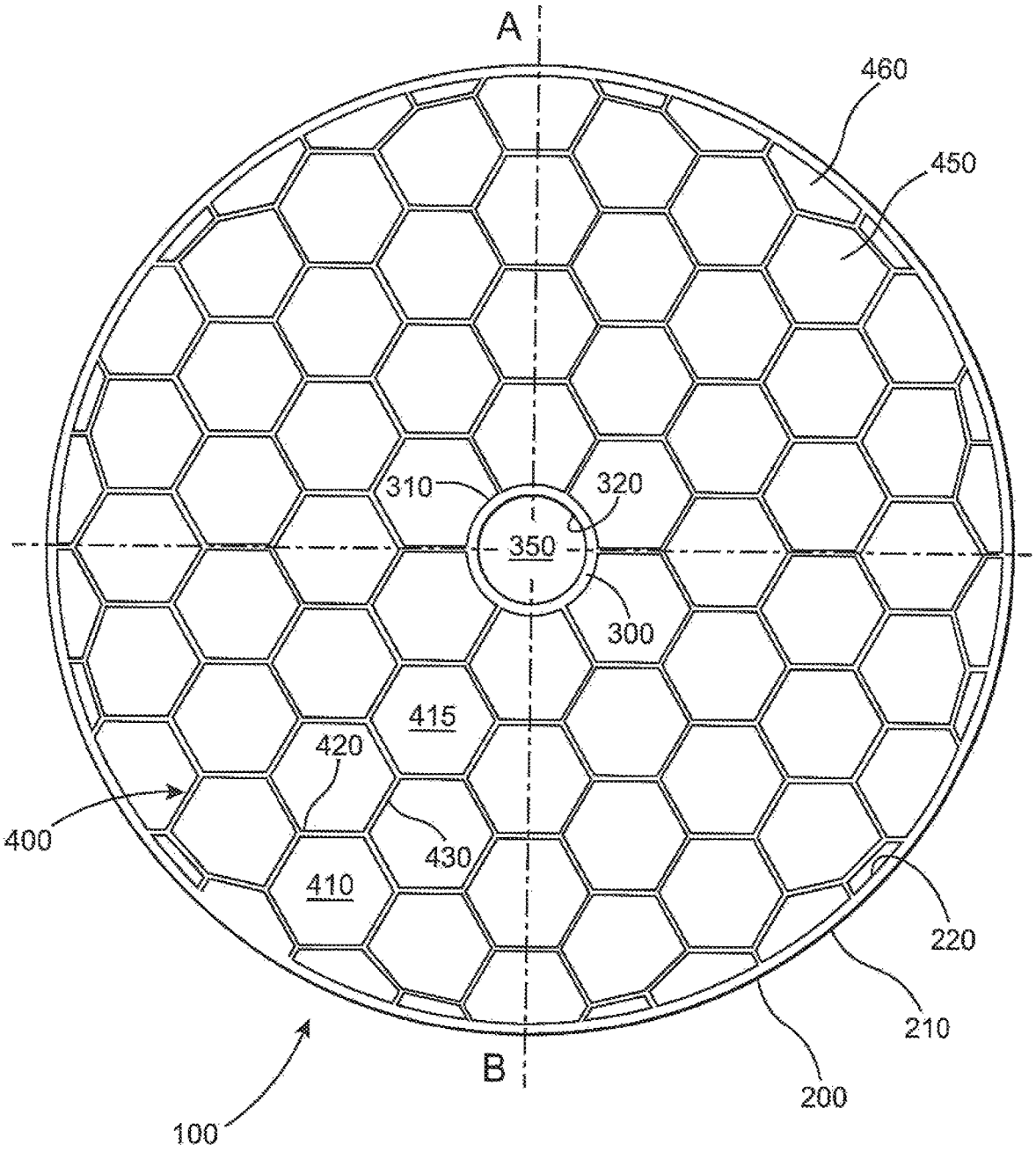
FIG. 2 is a plan view of the embodiment of FIG. 1.

With reference to FIG. 2, the collar 300 comprises an outer circumference 310 and an inner circumference 320. The bore 350 is defined by the inner circumference 320. The peripheral rim 200 comprises an outer circumference 210 and an inner circumference 220. The lattice 400 extends between the inner circumference 320 of the peripheral rim 300 and the outer circumference 210 of the collar 200.

With further reference to FIG. 2, the lattice 400 comprises a plurality of walls 430. These walls define a plurality of holes 410. The walls 430 provide inner stability and structure to the plate 100. Furthermore, in at least one embodiment, the walls 430 may while providing shock-absorbing qualities.

Many of the holes 410 of the depicted embodiment are generally hexagonal, though other embodiments may include holes 410 of other shapes. Further, some of the holes 410 may be regular hexagons 415. Others of the holes 450 are not regular hexagons. In addition, some of the holes 460 may not be fully-formed hexagons. As the collar 300 and peripheral rim 200 of the embodiment of FIG. 2 are not hexagonal, where the lattice abuts the collar 300 and rim 200, a portion of the holes 460 are necessarily truncated.

The holes 410, 450, 460 serve to significantly reduce the amount of material in the plate 100. This lends to the plate 100 having a reduced overall weight as compared to a traditional plate of similar outward dimensions.

It should be appreciated that a plate 100 according to the present invention can have a number of possible dimensions to achieve the desired balance between strength and weight. That having been said, a number of specific dimensions are envisioned. These specific dimensions are provided as examples and are not to be limitations on the breadth of possible alternative dimensions.

Figure 3:
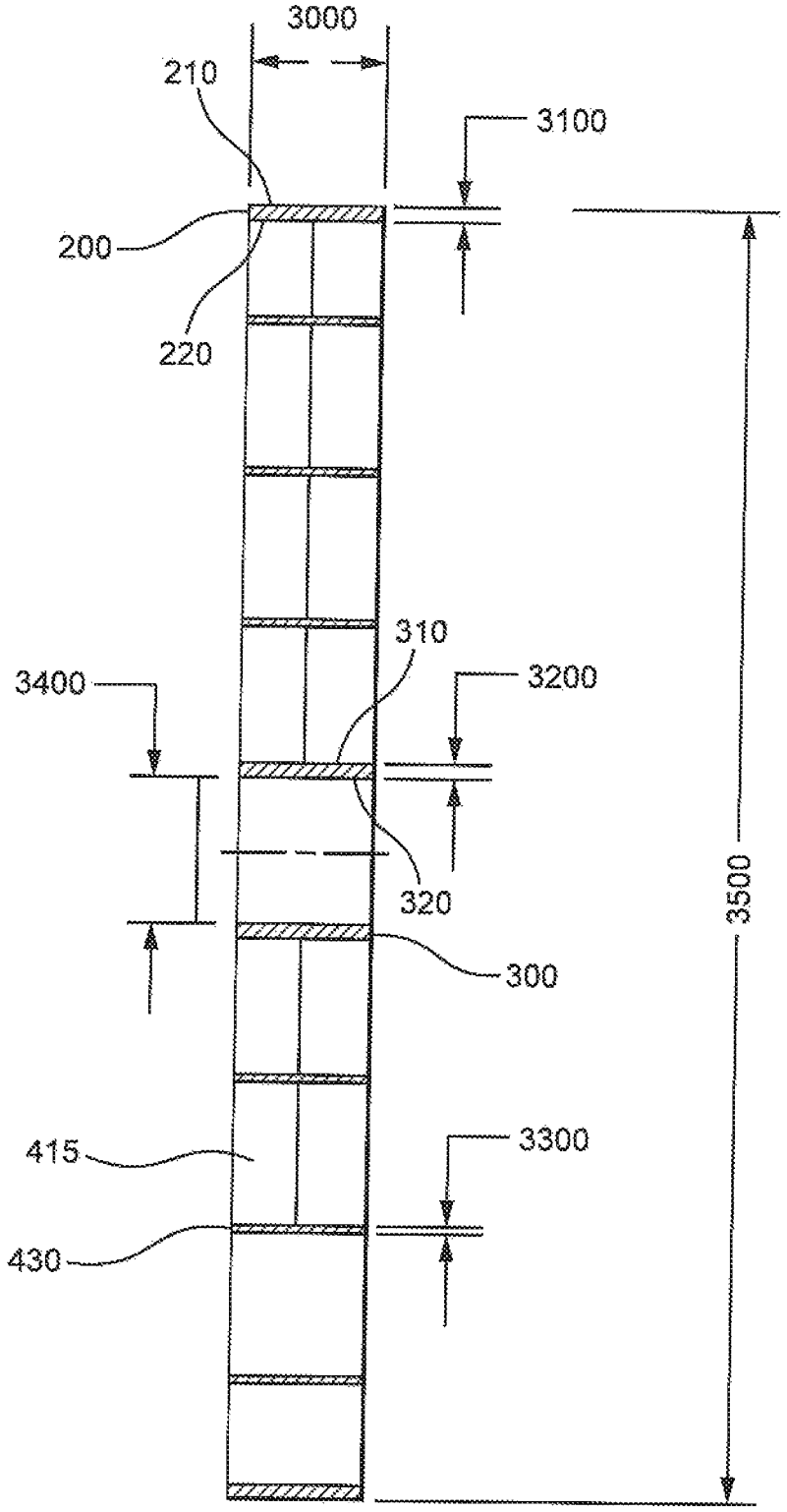
FIG. 3 is a cross section view of the embodiment of FIG. 2 along the AB line.

FIG. 3 depicts a cross section of the plate 100 taken along the AB line shown in FIG. 2. In the depicted embodiment, the peripheral rim 200 has a thickness 3100 between the outer circumference 210 and the inner circumference 220. In at least one embodiment, the thickness is 0.2 inches±0.015 inches. In addition, the collar 300 has a thickness 3200 between the outer circumference 310 and inner circumference 320. In at least one embodiment, the thickness is 0.2 inches±0.015 inches. The wall 430 has a thickness 330, which in at least one embodiment is 0.1 inches±0.015 inches. The collar 300 has a diameter 3400 of 2.00 inches±0.015 inches.

The plate 100 has a diameter 3500 of 17.72 inches±0.015 inches. Accordingly, when the end of a barbell is inserted in the bore 350, the barbell is elevated from the ground a distance of approximately 7 to 9 inches. This allows a user to exercise with proper form and technique as described above.

In one embodiment, the plate 100 has a width 3000 of 1.867 inches±0.01 inches with an overall weight of approximately 2 pounds. In another embodiment, the plate 100 has a width 3000 of 0.903 inches±0.01 inches with an overall weight of approximately 1.5 pounds.

Figure 4:
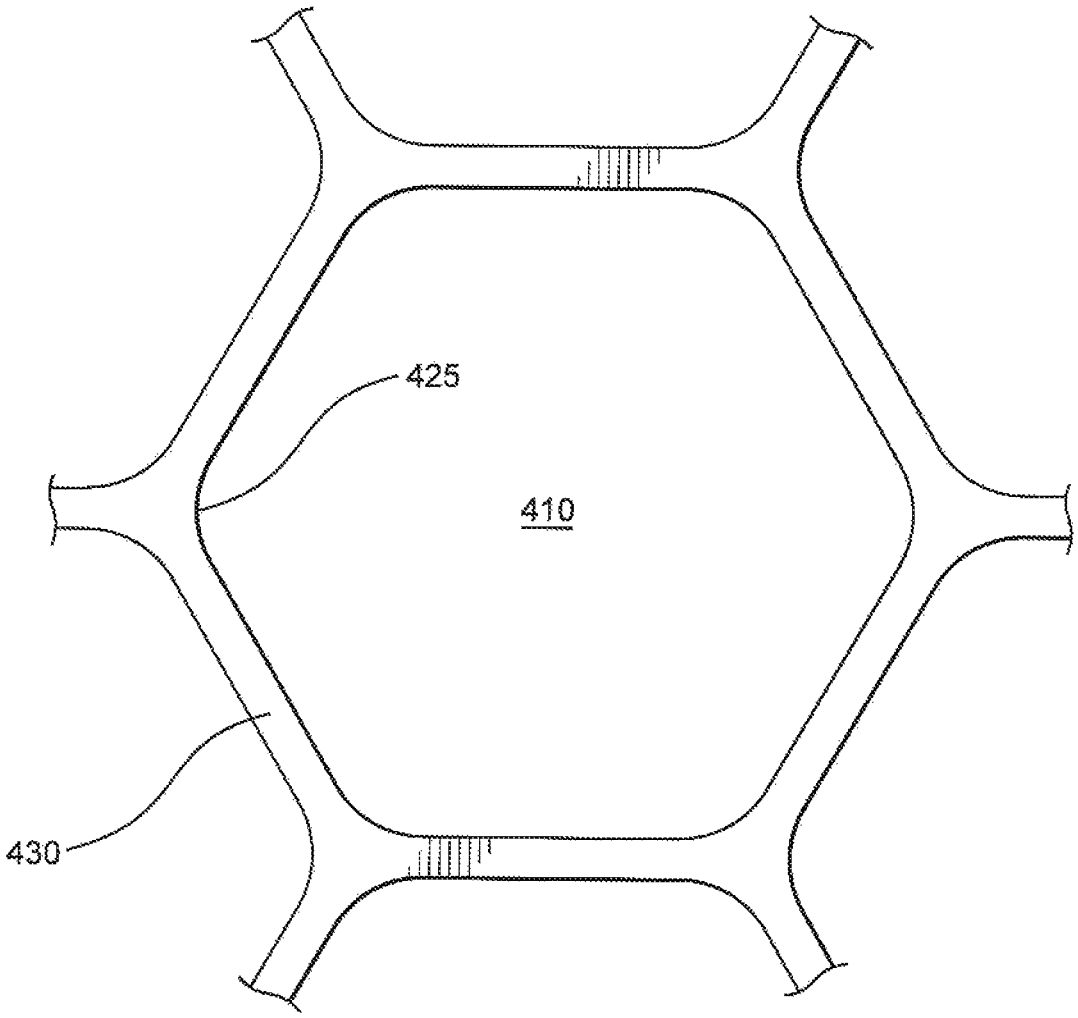
FIG. 4 is a close-up plan view of an embodiment of a hole.

FIG. 4 depicts a close-up view of the walls 430 and a hole 410 of an embodiment of the present invention. The inner corners 425 of the hole 410 are rounded. The rounded corners add increased strength, durability, and stability to the walls 430. It should be appreciated that inner corners of other shapes of holes, such as the holes 410, 415, 450, 460 of FIG. 2 may also be rounded.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A weight plate comprising:

a peripheral rim comprising an outer circumference and an inner circumference, a collar concentrically disposed relative to said peripheral rim, said collar comprising an outer circumference and an inner circumference, said inner circumference of said collar defining a central bore, said central bore being dimensioned and configured to receive a barbell, a lattice extending between said inner circumference of said peripheral rim and said outer circumference of said collar, and said lattice comprising a plurality walls, said plurality of walls defining a plurality of holes extending through said lattice, wherein said plurality of holes comprises a first set of regular hexagonal holes.

2. The weight plate of claim 1, wherein said plurality of holes comprises a second set of hexagonal holes that are not regular.

3. The weight plate of claim 2, wherein said plurality of holes comprises a third set of holes in the shape of truncated hexagons.

* * * * *